United States Patent [19]

Gordbegli

[11] 4,421,066

[45] Dec. 20, 1983

[54] HIGH EFFICIENCY BOILER

[75] Inventor: Manochehr Gordbegli, Santa Ana, Calif.

[73] Assignee: Teledyne Industries, Inc., Los Angeles, Calif.

[21] Appl. No.: 348,934

[22] Filed: Feb. 16, 1982

[51] Int. Cl.[3] ..... F22B 15/00

[52] U.S. Cl. ..... 122/264; 126/392

[58] Field of Search ..... 126/99 A, 101, 121, 126/126, 132, 133, 392, 390, 389; 123/41.54; 122/235 R, 235 C, 235 D, 235 F, 235 J, 264, 371

[56] References Cited

U.S. PATENT DOCUMENTS

| | | | |
|---|---|---|---|
| 361,727 | 4/1887 | Smith | 126/121 |
| 771,823 | 10/1904 | Hughes | 126/101 |
| 834,444 | 10/1906 | Bausher | 122/371 |
| 1,740,996 | 12/1929 | Muir | 126/121 |
| 2,052,643 | 9/1936 | Modine | 126/121 |
| 2,134,935 | 11/1938 | Winnett | 126/121 |
| 2,494,527 | 1/1950 | Walters | 126/121 |
| 3,965,886 | 6/1976 | Nelson | 126/121 |
| 4,122,824 | 10/1978 | Borcran | 126/121 |
| 4,147,153 | 4/1979 | Buckner | 126/121 |
| 4,204,517 | 5/1980 | Rumsey | 126/121 |
| 4,231,424 | 11/1980 | Moranne | 123/41.54 |
| 4,250,867 | 2/1981 | Andersen | 126/121 |
| 4,254,756 | 3/1981 | Wells | 126/121 |

*Primary Examiner*—Daniel J. O'Conner
*Attorney, Agent, or Firm*—Reagin & King

[57] ABSTRACT

A boiler is disclosed having a horizontal heat exchanger in the form of hollow tubes positioned across the top of a combustion chamber. Vertical heat exchangers are also provided at either ends of the tubes. The vertical heat exchangers are in the form of hollow water reservoirs which extend vertically between the tubes and the burner to form two walls of the combustion chamber.

1 Claim, 14 Drawing Figures

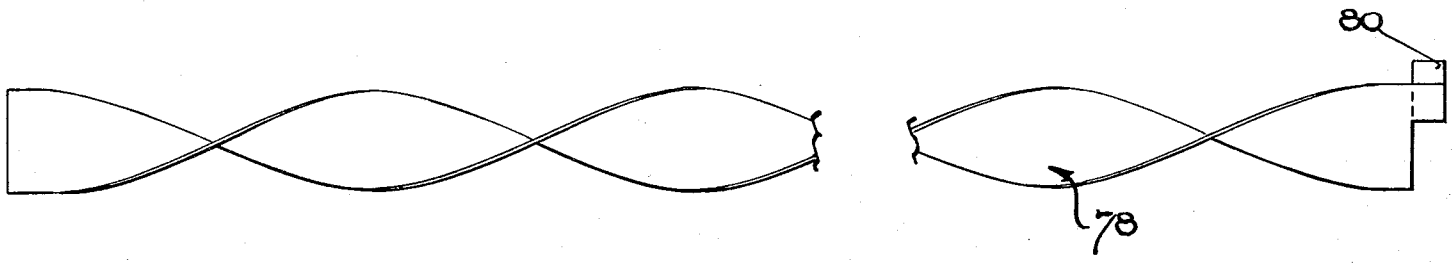
FIG. 13
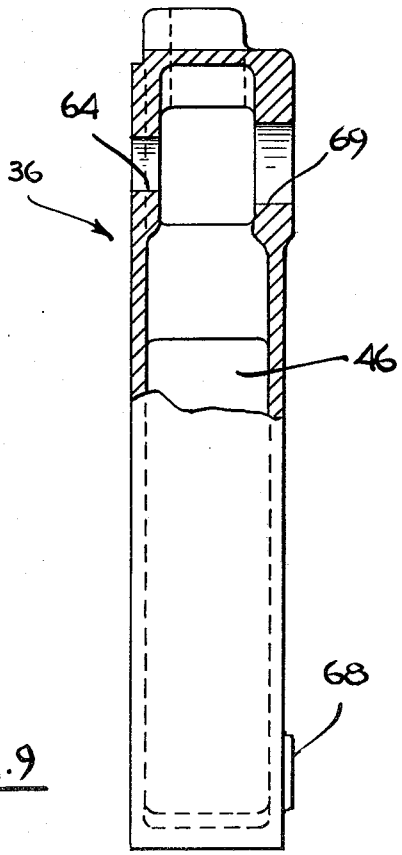
FIG. 9
FIG. 14
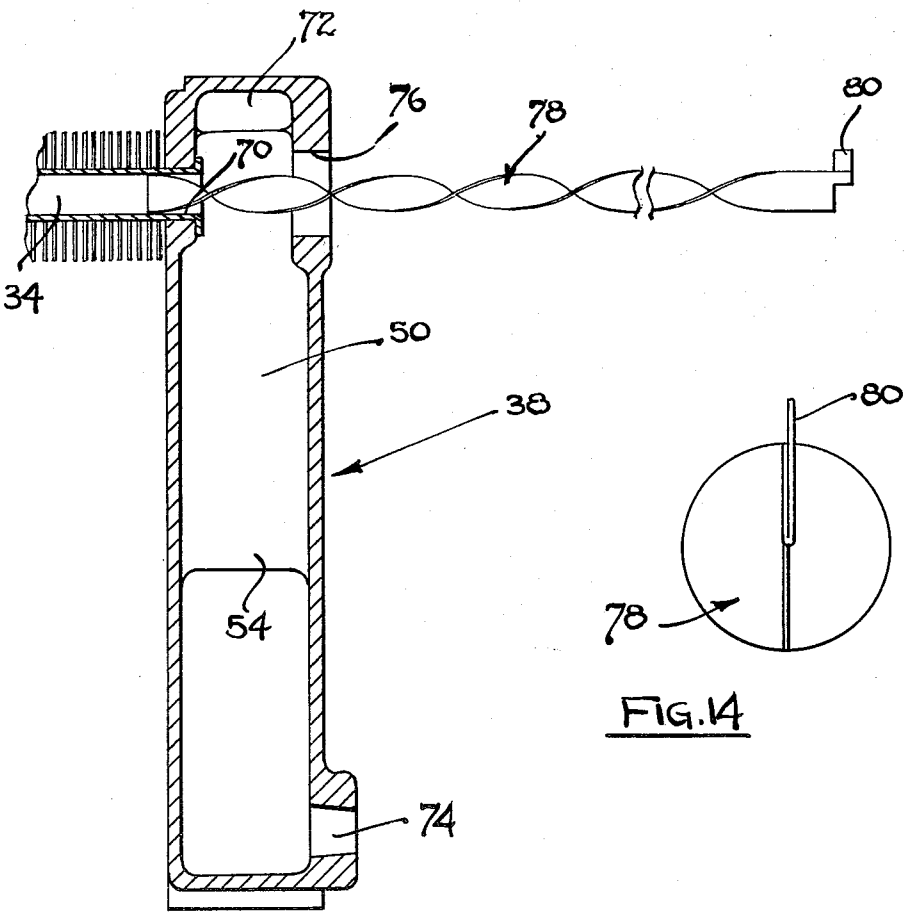
FIG. 12

HIGH EFFICIENCY BOILER

BACKGROUND OF THE INVENTION

This invention relates to boilers and more particularly to high efficiency water boilers for use in hydronic heating systems for residential application and the like.

There have been many boilers devised over the years for heating water used in residential hydronic heating systems. In general, each of these boilers comprises a housing which contains an insulated combustion chamber. The combustion chamber contains a burner unit which is connected to a fuel source such as pressurized gas. Combustion of a mixture of gas and air in the chamber causes the radiation of heat outwardly from the burner unit and the generation of convection currents of hot combustion products which rise toward an exhaust outlet at the top of the combustion chamber. In passing to the exhaust outlet the convection currents of hot combustion products flow past a heat exchanger which may comprise a series of thin copper tubes lying in a horizontal plane and carrying the water to be heated. The tubes conduct the heat acquired by radiation and conduction to the water flowing through the tubes. Headers are provided at both ends of the tubes to route the water from an inlet port, through the tubes and then to an outlet port.

While the use of horizontally disposed copper tubes as a heat exchanger provides rapid water heating, this configuration possesses several disadvantages. For example, the hot air rising in the combustion chamber transfers significant amounts of heat to the side walls of the housing. Accordingly, all of the walls of the housing must be insulated, typically by refractory material. The required thick sidewall insulation results in boilers which are both large and heavy. In addition, the heat transferred to the sidewalls by convection and radiation does not contribute to increased water temperature, resulting in a loss of boiler efficiency.

Accordingly, it is an object of this invention to provide a new and improved boiler.

It is another object of this invention to provide a high efficiency boiler which is smaller and lighter in weight than prior art boilers having similar heating capacity.

It is yet another object of this invention to provide a boiler which employs both horizontal and vertical heat exchangers.

SUMMARY OF THE INVENTION

These and other objects of the invention are realized by an improved boiler design having both horizontal and vertical heat exchangers. The horizontal heat exchangers are in the form of a row of thin copper tubes having a baffle system designed to direct the flow of convection currents over the tubes. The vertical heat exchangers include water reservoirs connected to the open ends of the horizontal tubes and extending down two sides of the boiler housing. The water flowing through the horizontal copper tubes is directed through the water reservoirs by partitions within the vertical heat exchangers. The vertical heat exchangers also perform the function of the headers employed in prior art boilers, routing of the water from the inlet port to the horizontal tubes and then to the outlet port of the boiler. The vertical heat exchangers provide additional heating of the water by absorbing heat produced in the combustion chamber. In addition, the vertical heat exchangers act as water jackets for two sides of the boiler housing, eliminating the need for refractory material insulation on these sides. The result is a small, light weight boiler which is approximately 10% more efficient than boilers utilizing only horizontal heat exchangers.

Other objects, features and advantages of the invention will become apparent from a reading of the specification in conjunction with the drawings, in which like reference numerals refer to like elements in the several views.

BREIF DESCRIPTION OF THE DRAWINGS

FIG. 9 is another cross-sectional view of the vertical heat exchanger of FIG. 7 taken along the line 9—9 of FIG. 7;

FIG. 12 is a cross-sectional view of the vertical heat exchanger of FIG. 10, taken along the line 12—12 of FIG. 10 and showing the method of assembly of the horizontal heat exchanger tubes and water deflectors;

FIG. 13 is a side view of the water deflector used within the horizontal heat exchanger tubes of the present invention; and FIG. 14 is an end view of the water deflector shown in FIG. 13.

DESCRIPTION OF THE PREFERRED EMBODIMENT

Figure 1:
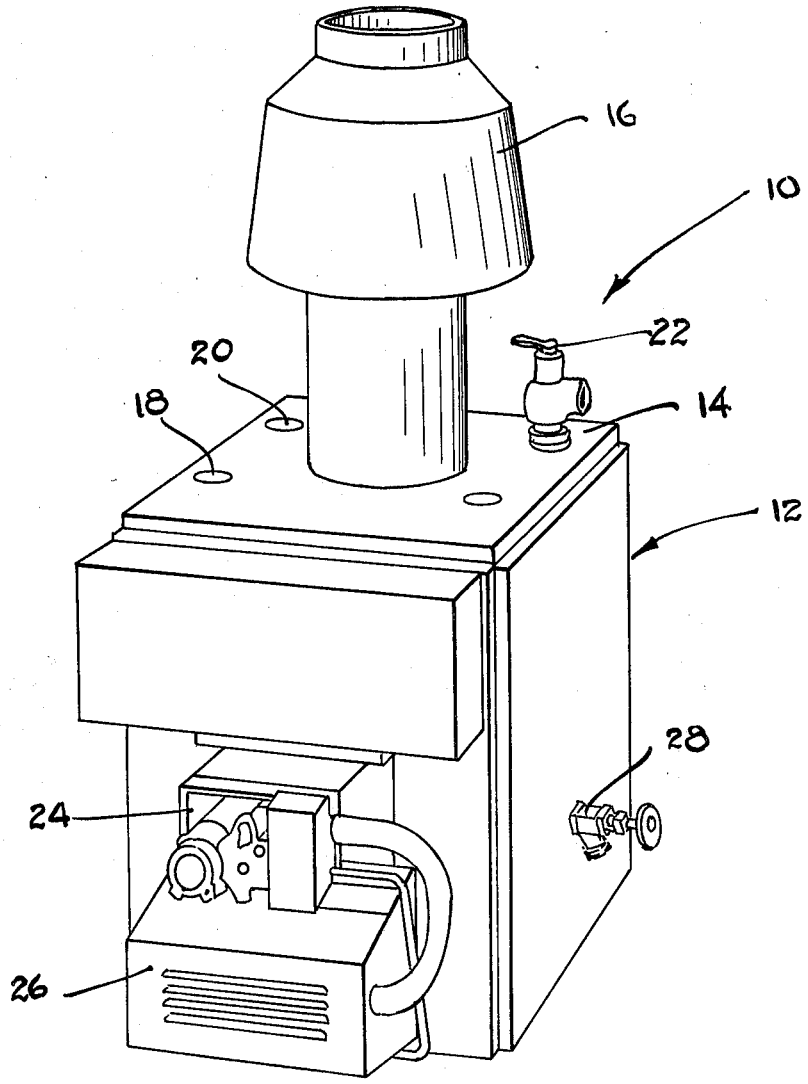
FIG. 1 is a perspective view of a boiler constructed in accordance with the invention.

Referring to FIG. 1, there is shown a perspective view of the boiler 10 constructed in accordance with the invention. The boiler 10 includes a rectangular housing 12 and a top 14 mounting a stack 16 to which exhaust gases are vented. Access is provided through the top 14 to an inlet port 18 and an outlet port 20 for connections to a water supply to be heated by the boiler 10. A pressure relief valve 22 is mounted through the top 14 to one of the heat exchangers within the boiler 10 as described below. Mounted to the front of the boiler 10 are a gas valve 24 and a burner enclosure 26. A drain valve 28 is mounted to the right side of the heater to provide means for draining water from a portion of the boiler.

Figure 2:
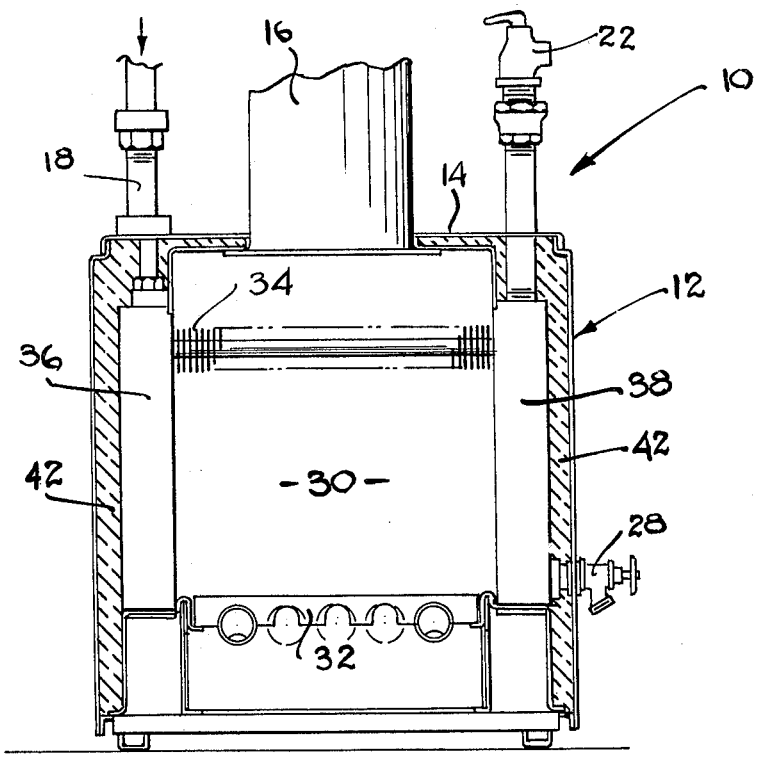
FIG. 2 is a front view of the boiler shown in FIG. 1, cut away to show the internal construction.
Figure 3:
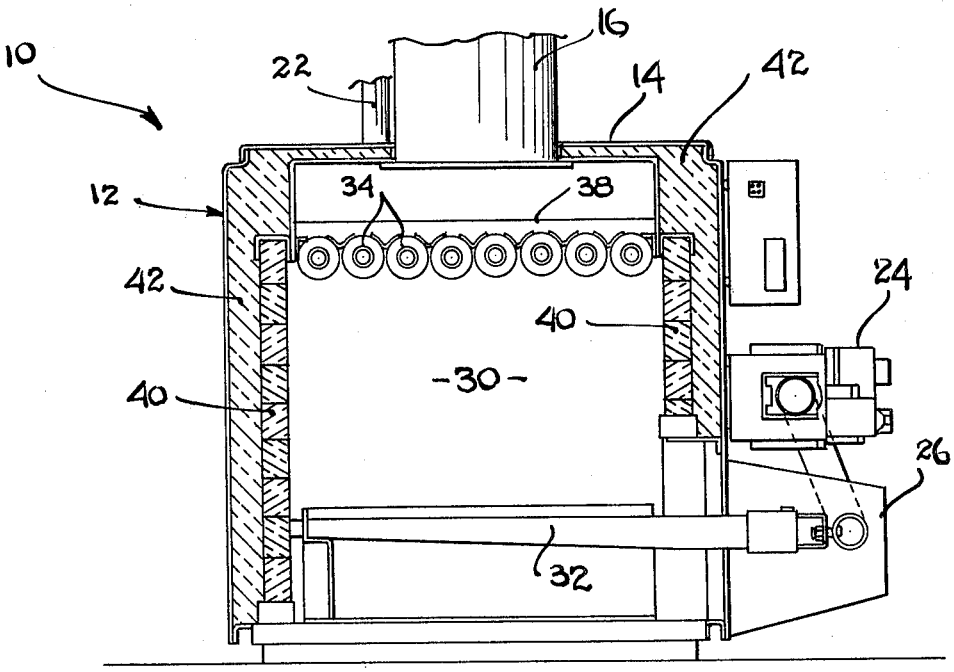
FIG. 3 is a left side view of the boiler shown in FIG. 1, cut away to show the internal construction.

FIGS. 2 and 3 are, respectively, front and left side views of the boiler 10, cut away to show detail of the internal construction. Within the housing 12 is situated a combustion chamber 30, at the bottom of which is a gas burner 32. The burner 32 is connected to the gas valve 24 and associated heating controls which initiate combustion within the chamber 30. Such heating controls are well known to those skilled in the art. At the top of the combustion chamber 30 are situated eight finned tubes 34 as shown in FIG. 3, which may be constructed of a material such as copper. The tubes 34 form a horizontal heat exchanger and are connected at their ends to a pair of vertical heat exchangers 36 and 38 as shown in FIG. 2.

The first heat exchanger 36 (which may be referred to as the input/output vertical heat exchanger) and the second heat exchanger 38 (which may be referred to as the return vertical heat exchanger) extend the height of the chamber 30 from the burner 32 to the tubes 34, thus forming two of the vertical walls of the chamber 30. The remaining two walls of the combustion chamber 30 are formed of a heat insulating material such as refractory brick 40. Light weight heat insulating material such as fiberglass 42 is also provided between the walls of the housing 12 and the outside surfaces of the combustion chamber 30. The tubes 34 and the vertical heat exchangers 36 and 38 form a heat exchanger assembly through which heat is transferred from the combustion chamber 30 to the water flowing through the boiler 10.

Figure 4:
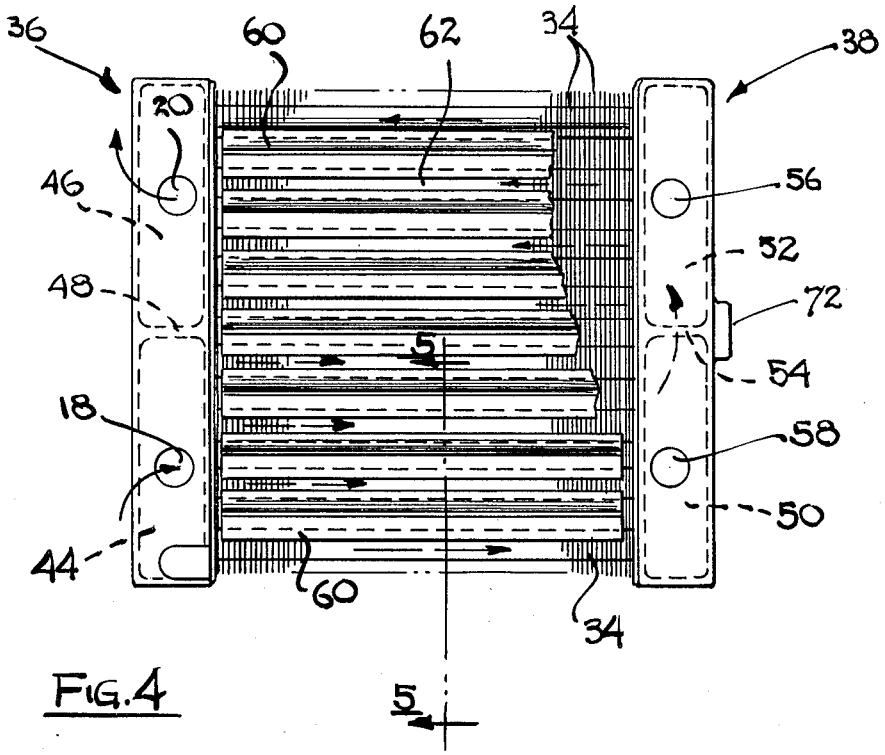
FIG. 4 is a top view of the heat exchanger assembly employed in the boiler of the present invention, showing the horizontal heat exchanger attached to the vertical heat exchangers.

FIG. 4 is a top view of the heat exchanger assembly showing the vertical heat exchangers 36 and 38 joined to the ends of the horizontal tubes 34. The arrows in FIG. 4 indicate the direction of water flow through the various heat exchangers in the operation of the boiler 10. Water from an external source enters the input/output vertical heat exchanger 36 through the inlet port 18. The heat exchanger 36 is in the form of a hollow rectangular casting having a central partition wall 48, shown in more detail in FIG. 7 below, which extends the entire vertical length of the heat exchanger 36, dividing it into two separate hollow cavities or chambers 44 and 46 which act as water reservoirs. The ends of the tubes 34 are joined to the heat exchanger 36 through openings which communicate with its interior, whereby four of the finned tubes 34 communicate with the chamber 44 and the remaining four tubes 34 communicate with the chamber 46.

The opposite ends of the tubes 34 are joined to the return vertical heat exchanger 38 through openings which communicate with its interior. The heat exchanger 38 is similar in construction to that of the heat exchanger 36, and is divided into cavities or chambers 50 and 52 by a central partition wall 54. However, as shown in more detail in FIG. 10 below, the partition wall 54 of the heat exchanger 38 extends vertically only part way down its length. Accordingly, water which enters the chamber 50 also flows into the chamber 52. The water continues to flow out of the chamber 52 through four of the tubes 34 and into the chamber 46 of the input/output vertical heat exchanger 36. The water exits the boiler 10 through the outlet port 20, as shown by the arrows in FIG. 4. Ports 56 and 58 are provided in the top of the return vertical heat exchanger 38 for mounting components such as the pressure relief valve 22. The heat exchangers 36 and 38 are formed of a material such as cast iron.

Figure 5:
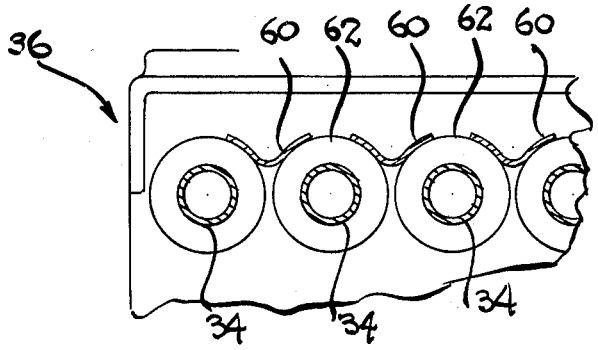
FIG. 5 is a cross-sectional view of the horizontal heat exchanger taken along the line 5—5 of FIG. 4.

As shown in FIG. 4, the finned tubes 34 are covered on their top surface by a plurality of shields or baffles 60 which are constructed to direct the convection currents produced by the combustion products in the combustion chamber 30 to flow in intimate contact with the surfaces of the tubes 34. As shown in FIG. 5, the baffles 60 are generally wing shaped and have a series of apertures 62 positioned to allow the escape of the exhaust gases upward. This configuration of the baffles 60 forces convection currents to remain closely adjacent the tubes 34 and provides a longer period of time for heat exchange to occur.

Figure 7:
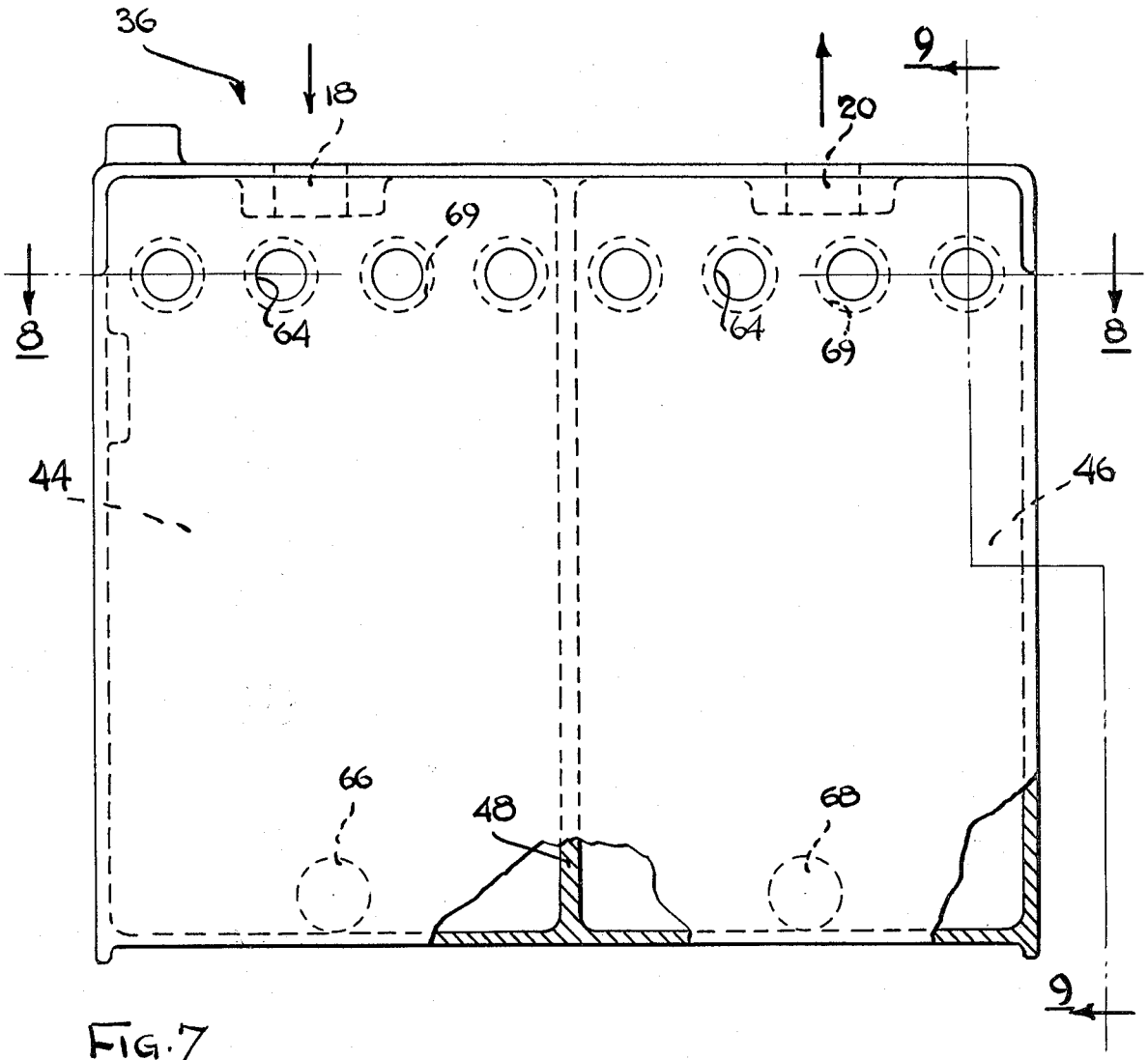
FIG. 7 is a side view, partially cut away, of one of the vertical heat exchangers employed in the boiler of the present invention.
Figure 8:
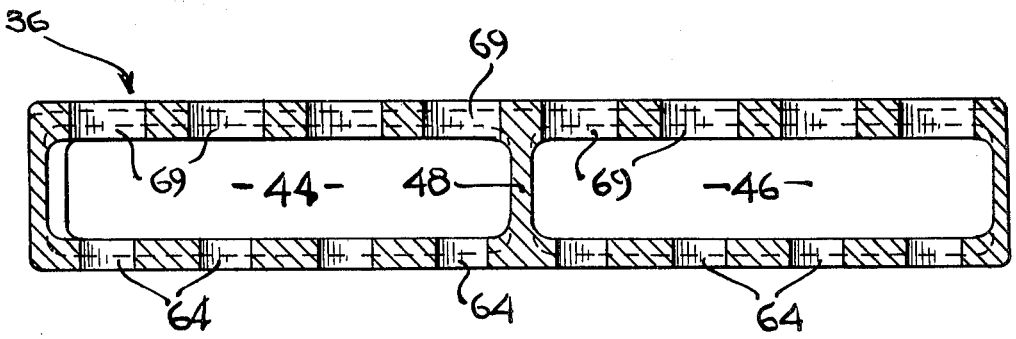
FIG. 8 is a cross-sectional view of the vertical heat exchanger of FIG. 7 taken along the line 8—8 of FIG. 7.

FIGS. 7, 8, and 9 show the details of construction of the input/output vertical heat exchanger 36. FIG. 7 is a partially cut away view showing the side of the heat exchanger 36 which is joined to the finned tubes 34 through the holes 64. It can be seen from the figures that the heat exchanger 36 has a hollow rectangular interior which is divided into the two cavities 44 and 46 by the central partition wall 48 which extends vertically the length of the heat exchanger 36. Four holes 64 are located adjacent the top of each of the cavities 44 and 46 and are used for joining the ends of the tubes 34 to the heat exchanger 36. The holes 64 also serve as a path for the water to enter the cavities 44 and 46. At the bottom of the cavities 44 and 46 are provided drain holes 66 and 68 which may be connected to suitable drain valves mounted external to the boiler 10. The inlet and outlet ports 18 and 20 are provided in the top surface of the cavities 44 and 46, respectively. As shown in FIGS. 8 and 9, access holes 69 are coaxially located behind each of the holes 64 in the opposite wall of the heat exchanger 36. As described below, the access holes 69 are used to assist the operation of joining the tubes 34 to the heat exchanger 36 and are also used to insert water deflectors into the tubes 34, as described in FIGS. 13 and 14 below.

Figure 10:
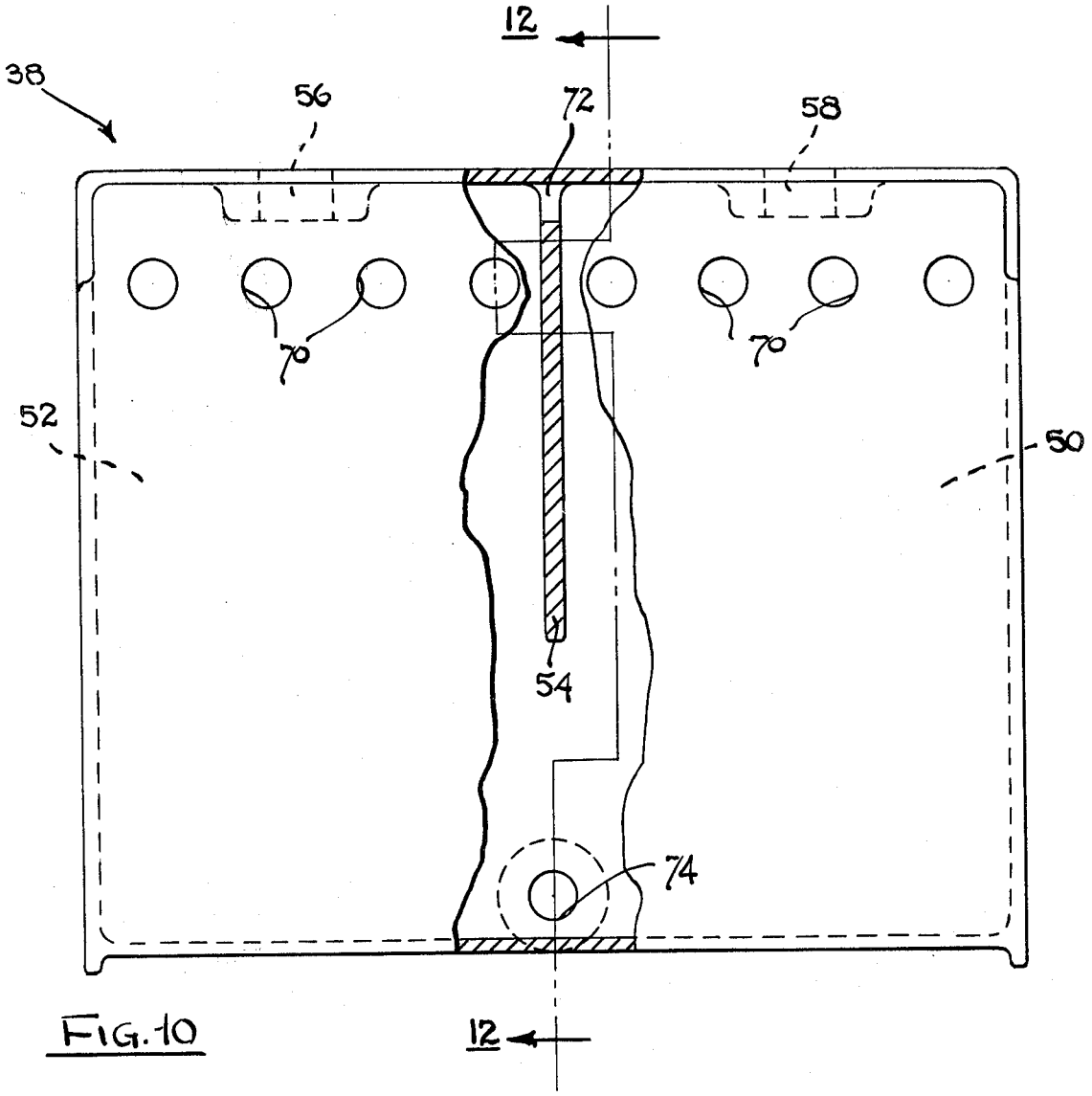
FIG. 10 is a side view, partially cut away, of the other vertical heat exchanger employed in the boiler of the present invention.
Figure 11:
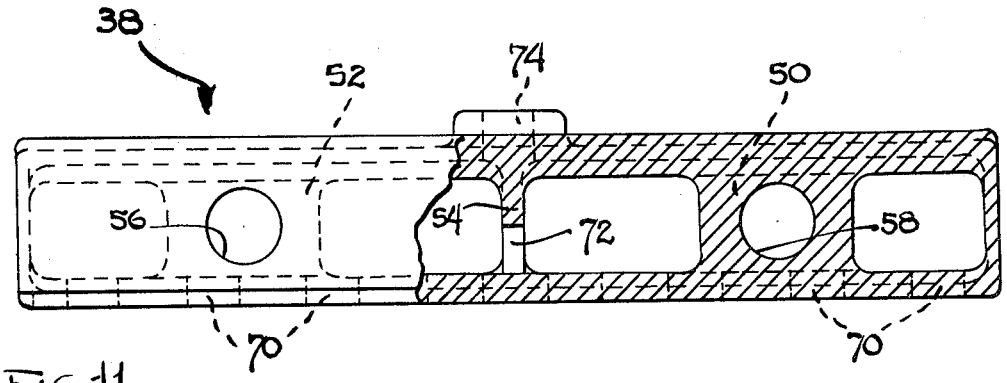
FIG. 11 is a top view, partially cut away, of the vertical heat exchanger of FIG. 10.

FIGS. 10, 11, and 12 show the details of construction of the return vertical heat exchanger 38. FIG. 10 is a view showing the side of the heat exchanger 38 which is joined to the tubes 34. It can be seen that the heat exchanger 38 has a hollow rectangular interior and is similar in construction to the heat exchanger 36; however, the center partition wall 54 extends vertically only part way down the length of the heat exchanger 38, providing an opening for water to flow between the two cavities 50 and 52. The length of the wall 54 is optimized so that substantial amounts of water entering the cavity 50 from the tubes 34 through holes 70 flow down to the bottom of the heat exchanger 38 before exiting through the chamber 52 and the holes 70 provided therein.

A small slot 72 is provided through the partition wall 54 at the top of the heat exchanger 38, as shown in FIGS. 10 and 11. Slot 72 acts as a path for air bubbles which may be trapped in the water line. The slot 72 allows such air to pass quickly from the chamber 50 to the chamber 52 and hence outward toward the outlet port 20 in the heat exchanger 36. The slot 72 thus prevents the accumulation of large air bubbles within heat exchanger 38. A drain hole 74 is also provided at the bottom of the heat exchanger 38 and may be connected to the external drain valve 28 as shown in FIG. 1.

FIG. 12 is a cross-sectional view taken along the line 12—12 of FIG. 10 and illustrates the manner of attachment of the finned tubes 34 to the heat exchanger 38. It can be seen that the end of each tube 34 is passed through a respective hole 70, and then expanded to form a tight fit with the wall of the heat exchanger 38. Access holes 76 are provided coaxial with each of the holes 70 to permit the insertion of a tool into the interior of the heat exchanger 38 to perform the expansion operation on the ends of each of the tubes 34. In like manner, the opposite ends of the tubes 34 are attached to the heat exchanger 36 through the holes 64 provided therein. The access holes 69 allow the insertion of the expansion tool to fasten the tubes 34 to the heat exchanger 36.

FIGS. 13 and 14 illustrate the design of a water deflector 78 which is inserted into the interior of each of the hollow tubes 34 to minimize the level of noise generated by the operation of the boiler 10. The deflector 78 is formed of thin sheets of a material such as stainless steel which are twisted into a spiral shape and which extend the length of the tube 34. One end of the deflector 78 is further formed to have a tab 80 which projects outward from the deflector 78.

Figure 6:
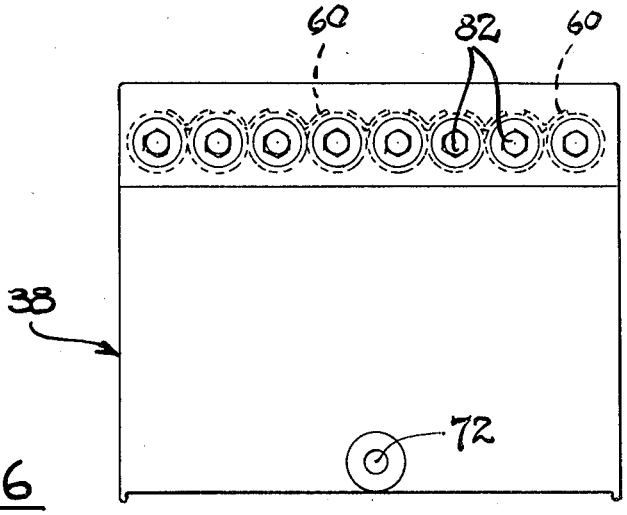
FIG. 6 is a side view of the heat exchanger assembly shown in FIG. 4.

Referring to FIG. 12, the deflector 78 is inserted into the tube 34 by passing the deflector 78 through the access hole 76 of the heat exchanger 38. In each of the tubes 34 the deflector 78 is oriented so that the tab 80 is positioned at that end of the tube 34 through which water enters. The tab 80 projects outward from the deflector 78 to prevent the deflector 78 from being pushed through the tube 34 by the force of the flowing water. The deflector 78 is formed to provide a snug fit within the tube 34 so that the deflector 78 does not rotate. Referring to FIG. 4, it can be seen that water enters four of the tubes 34 from the heat exchanger 38. Accordingly, four of the deflectors 78 are inserted into the tube 34 through the access holes 69 located in the cavity 44 of the input/output vertical heat exchanger 36. The remaining four deflectors 78 are inserted into the tubes 34 through the access holes 76 located in the chamber 52 of the return vertical heat exchanger 38. After the deflectors 78 have been installed, the access holes 69 and 76 are closed by threaded plugs 82 as shown in FIG. 6.

In the operation of the boiler 10, the burner 32 at the bottom of the combustion chamber 30 is operated to burn a mixture of gas and air, which produces radiation of energy. This radiation acts to heat the interior of the combustion chamber 30 including the finned tubes 34 and the vertical heat exchangers 36 and 38 which form two of the walls of the combustion chamber 30. In addition, the combustion products at the base of the combustion chamber 30 expand and create upward flowing convection currents which carry heat past the surfaces of the vertical heat exchangers 36 and 38 and the finned tubes 34.

As shown in FIG. 4, the water to be heated flows first into the input/output vertical heat exchanger 36, fills the chamber 44 which acts as a water reservoir, and flows through four of the tubes 34 into the chamber 50 of the return vertical heat exchanger 38. The partition wall 54 insures that substantial amounts of the water flow down into the chamber 50, which also acts as a water reservoir. The water then flows into and fills chamber 52 and eventually exits through four of the tubes 34. The water proceeds into and fills the chamber 46 of the input/output vertical heat exchanger 36 and eventually exits the boiler through the outlet port 20.

The combination of the horizontal heat exchanger formed by the tubes 34 and the two vertical heat exchangers 36 and 38 provide a large heating surface area to intercept both the radiation and the convection currents produced in the combustion chamber 30. The result is fast and efficient heating of the water flowing through the boiler 10.

The reservoirs of water formed by the cavities within the two vertical heat exchangers 36 and 38 also act as water jackets for two sides of the boiler 10. In essence, the water in the heat exchangers 36 and 38 maintains their surface temperature close to the temperature of the heated water. This temperature is significantly lower than the temperature of the hot gases produced within the chamber 30. Accordingly, there is no need to provide refractory material along the two sides of the housing 12 which are adjacent the vertical heat exchangers 36 and 38. Refractory insulation material is thus only employed for the front and rear sides of the boiler 10 as shown in FIG. 3. The relatively cool surface of the vertical heat exchangers also reduces radiant heat transfer within the combustion chamber and thus provides a less hostile environment for internal boiler components (notably burners).

It can be seen that the vertical heat exchangers 36 and 38 perform several functions which provide substantial improvements in the design of the boiler 10. They serve the function of a manifold to route the water through the tubes 34. They also serve as water reservoirs to significantly increase the water capacity of the boiler 10. They also serve to increase the efficiency of the transfer of heat from the combustion chamber 30 to the water. They further serve as water jackets which eliminate the need for refractory insulation material along two sides of the boiler 10.

The boiler configuration described above results in a small, light weight and efficient boiler. By way of example, a 50,000 BTU per hour boiler may be constructed within a housing having the dimensions of 34.4 centimeters wide, 44 centimeters deep and 45.7 centimeters high, and weighing approximately 45 kilograms. It is believed that boilers constructed according to the present invention are approximately 10% more efficient than those constructed using prior art boiler designs.

While the invention is disclosed in a particular embodiment and described in detail it is not intended that the invention be limited solely to that embodiment. Many modifications will occur to those skilled in the art which are within the spirit and scope of the invention. It is thus intended that the invention be limited in scope only by the appended claims.

What is claimed is:

1. A boiler comprising a housing; a combustion chamber in the housing; a burner situated at the bottom of the chamber; a horizontal heat exchanger including a plurality of hollow tubes positioned horizontally within the chamber; a first vertical heat exchanger including a water reservoir and positioned to form a first vertical wall of the combustion chamber and further including a hollow body which extends from a first end of the hollow tubes to the burner, a vertical partition wall within the body which extends the length of the body to divide the interior of the first vertical heat exchanger into first and second cavities, and means for connecting the first end of some of the hollow tubes to communicate with the first cavity and the first end of the remainder of the hollow tubes to communicate with the second cavity; and a second vertical heat exchanger including a water reservoir and positioned to form a second vertical wall of the combustion chamber and further including a hollow body which extends from a second end of the hollow tubes, means for connecting the second ends of the hollow tubes to communicate with the interior of the second vertical heat exchanger, a second vertical partition wall within its hollow body which extends a portion of the length of the body to divide the second vertical heat exchanger into two cavities which communicate with each other, where the second vertical partition wall extends from the top of the hollow body a length sufficient to ensure that a substantial amount of water flowing into one of the cavities reaches the bottom of the hollow body before entering the other cavity, and further includes a slot through the second vertical partition wall adjacent the top of the hollow body to permit the rapid escape of trapped air from the boiler.

* * * * *